United States Patent [19]

Lindberg

[11] Patent Number: 4,794,865

[45] Date of Patent: Jan. 3, 1989

[54] AMUSEMENT RIDE VEHICLE

[75] Inventor: Arnold Lindberg, Orlando, Fla.

[73] Assignee: The Walt Disney Company, Burbank, Calif.

[21] Appl. No.: 50,325

[22] Filed: May 18, 1987

[51] Int. Cl.[4] ..... B61B 13/12; B61F 9/00

[52] U.S. Cl. ..... 104/246; 104/63; 104/109; 104/243; 105/30; 105/49; 105/101; 105/215.1

[58] Field of Search ..... 104/243, 63, 106, 107, 104/109, 242, 243, 245, 246; 105/30, 49, 73, 101, 215.1

[56] References Cited

U.S. PATENT DOCUMENTS

| | | | |
|---|---|---|---|
| 303,131 | 8/1884 | Denechaud, Sr. | 104/246 |
| 328,679 | 10/1885 | Hogset . | |
| 1,188,116 | 6/1916 | Title . | |
| 1,252,998 | 1/1918 | Castanko | 104/246 |
| 1,373,992 | 4/1921 | Benjamin | 104/246 |
| 1,463,137 | 7/1923 | Makepeace | 104/246 |
| 1,581,713 | 4/1926 | Adams | 104/246 |
| 1,588,505 | 6/1926 | Thacher . | |
| 1,612,271 | 12/1926 | Edson | 104/246 |
| 1,764,941 | 6/1930 | Edson . | |
| 1,791,663 | 2/1931 | Edson . | |
| 2,018,087 | 10/1935 | Plass . | |
| 2,539,360 | 1/1951 | Bartlett . | |
| 2,800,861 | 7/1957 | Michalski | 104/246 |
| 3,050,016 | 8/1962 | Fischer | 104/245 |
| 3,111,094 | 11/1963 | Wylie | 104/246 |
| 3,114,332 | 12/1963 | Bacon et al. | 104/246 |
| 3,143,081 | 8/1964 | Dolphin et al. | 104/246 |
| 3,249,065 | 5/1966 | Adams et al. . | |
| 3,352,254 | 11/1967 | Lauber | 105/215.1 |
| 3,429,280 | 2/1969 | Dashew et al. | 105/30 |
| 3,446,158 | 5/1969 | Pettit . | |
| 3,540,380 | 11/1970 | Tumpak et al. | 104/246 |
| 3,554,130 | 1/1971 | Broggie et al. . | |
| 3,584,583 | 6/1971 | Cartwright | 104/246 |
| 3,593,667 | 7/1971 | Morris | 104/246 |
| 3,631,805 | 1/1972 | Schwarzkopf | 104/63 |
| 3,648,617 | 3/1972 | Metzner et al. | 104/245 |
| 3,729,890 | 5/1973 | Yamamoto et al. | 104/246 |
| 3,831,527 | 8/1974 | Peterson | 105/215.1 |
| 3,841,225 | 10/1974 | Johnson | 105/215.1 |
| 3,855,936 | 12/1974 | Schwarzkopf | 104/243 |
| 3,889,605 | 6/1975 | Bacon | 104/246 |
| 3,908,554 | 9/1975 | Schwarzkopf | 104/245 |
| 4,089,272 | 5/1978 | Schmitz | 104/246 |
| 4,221,170 | 9/1980 | Koudelka | 104/63 |
| 4,375,195 | 3/1983 | Tsuboi | 104/246 |

FOREIGN PATENT DOCUMENTS

| | | | |
|---|---|---|---|
| 27196 | of 1910 | United Kingdom | 104/246 |

*Primary Examiner*—George L. Walton

*Attorney, Agent, or Firm*—Fulwider, Patton, Rieber, Lee & Utecht

[57] ABSTRACT

An amusement ride vehicle for travel along a trackway defined by a pair of track rails. The vehicle includes a pair of transverse frames pivotally carried by an elongated main frame, with drive wheels carried by the transverse frames in driving engagement with upper surfaces of the track rails. Up-stop or pinch wheels below the drive wheels engage under sides of the track rails. The pinch wheels are pivotally mounted to the transverse frames by strut assemblies which hold the pinch wheels in constant forcible rolling engagement with the track rails at all times. This improves the driving traction of the drive wheels and provides constant up-stop protection against separation of the vehicle from the track rails. The strut assemblies are disconnectable to enable the pinch wheels to be pivoted out of interfering relation with the track rails so that the vehicle can be lifted from the track rails for maintenance, storage or the like.

11 Claims, 3 Drawing Sheets

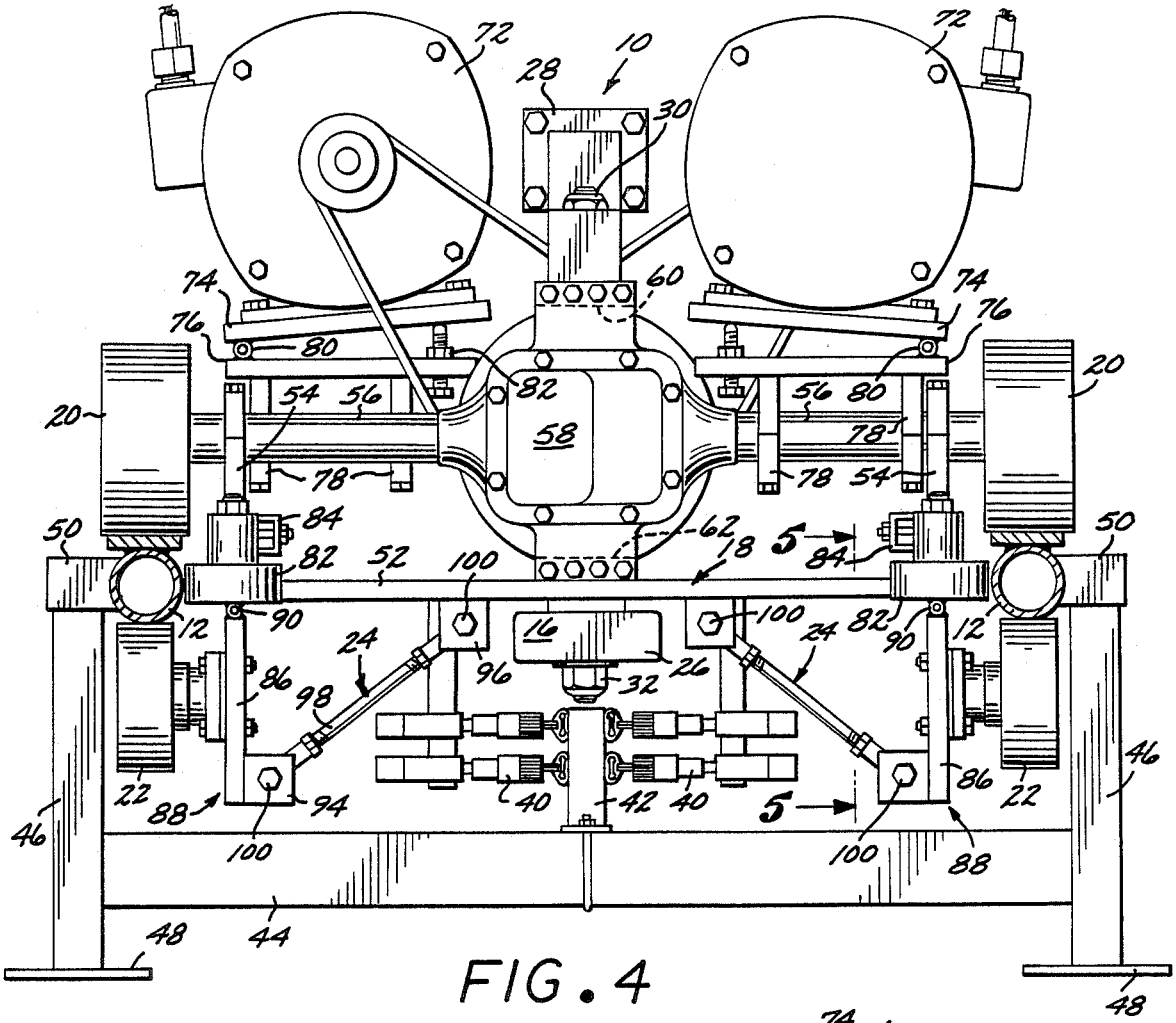
FIG. 4
FIG. 5
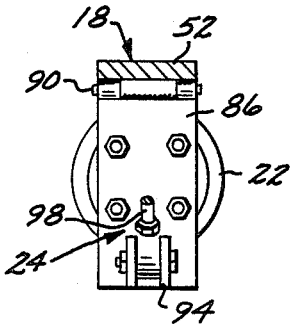
FIG. 6
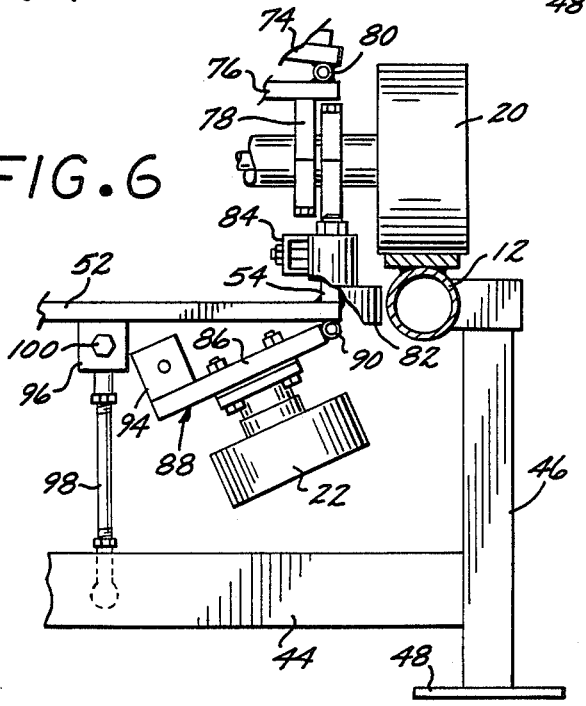

AMUSEMENT RIDE VEHICLE

BACKGROUND OF THE INVENTION

1. Field of the Invention

The present invention relates to an amusement ride vehicle for travel along a trackway defined by a pair of track rails, and more particularly to a vehicle incorporating drive wheels and pinch wheels which cooperate for increased driving traction and protection against vehicle separation from the track rails.

2. Description of Related Art

In a typical amusement ride, a train of vehicles is propelled along a pair of spaced apart track rails that define a trackway which changes in elevation and follows an irregular or serpentine path. A tractor or propulsion vehicle connected to a string of passenger vehicles form the ride train. More than one propulsion vehicle may be needed depending upon the weight of the loaded train and the grade to be negotiated.

One known form of propulsion vehicle incorporates motor driven driving axles having drive wheels which run on top of the track rails. Up-stop or vehicle separation protection is provided by fixed members which project beneath and engage the rails when there is any excessive upward travel of the vehicles. This function is sometimes served by up-stop.

Since the number of passenger vehicles that can be pulled or safely braked by a propulsion vehicle is a function of the train weight and the grade of the trackway, a significant number of additional propulsion vehicles are required for long trains or for steep grades.

Various systems have been advanced in the prior art for increasing the traction between a propulsion vehicle and a trackway so that greater loads can be carried including, by way of example, the systems of U.S. Pat. No. 3,648,617, issued Mar. 14, 1972 to Metzner al., and 3,584,583, issued June 15, 1971 to Cartwright. These systems are not specifically addressed to amusement ride vehicles in which it is important to have not only optimum traction but also constant up-stop protection and in which it is further important to accomplish this by mechanisms which will not interfere with periodic separation of the vehicle from the tracks for maintenance, storage or the like.

SUMMARY OF THE INVENTION

The invention provides an amusement ride vehicle employing pinch wheels which provide up-stop protection at all times, which operate in conjunction with drive wheels to increase drive wheel traction, and which are retractable out of interfering engagement with the track rails to enable separation of the vehicle from the rails for maintenance, storage and the like. Interengagement between the vehicle and the track rails is positive and relatively unyielding to prevent undesired upward movement of the vehicle at any time.

The vehicle of the invention includes a longitudinally oriented main frame which pivotally mounts a pair of transverse frames which carry drive wheels and oppositely disposed pinch wheels. The pinch wheels are mounted to wheel carriers which are each pivotally mounted to one of the transverse frames to enable the pinch wheels to be quickly pivoted out of the way of the track rails when it is desired to lift the vehicle off the rails for maintenance or storage. The pinch wheel carriers are forcibly urged against the track rails by strut assemblies whose length can be adjustably fixed. In operation each strut assembly is inextensible so that its pinch wheel is forced against its associated track rail with a force adequate to develop a drive wheel traction commensurate with the weight of the train and the steepness of the trackway grades.

The transverse frames preferably mount guide rollers for engagement with the inside track rail surfaces to guide the drive wheels and pinch wheels along a path conforming to the trackway configuration.

Other features and advantages of the invention will become apparent from the following detailed description, taken in conjunction with the accompanying drawings, which illustrate, by way of example, the features of the invention.

BRIEF DESCRIPTION OF THE DRAWINGS

FIG. 4 is an end elevational view of the propulsion vehicle;

FIG. 5 is a view taken along the line 5—5 of FIG. 4; and

FIG. 6 is a partial end elevational view of the up-stop wheel carrier assembly in its retracted position.

DESCRIPTION OF THE PREFERRED EMBODIMENT

Figure 1:
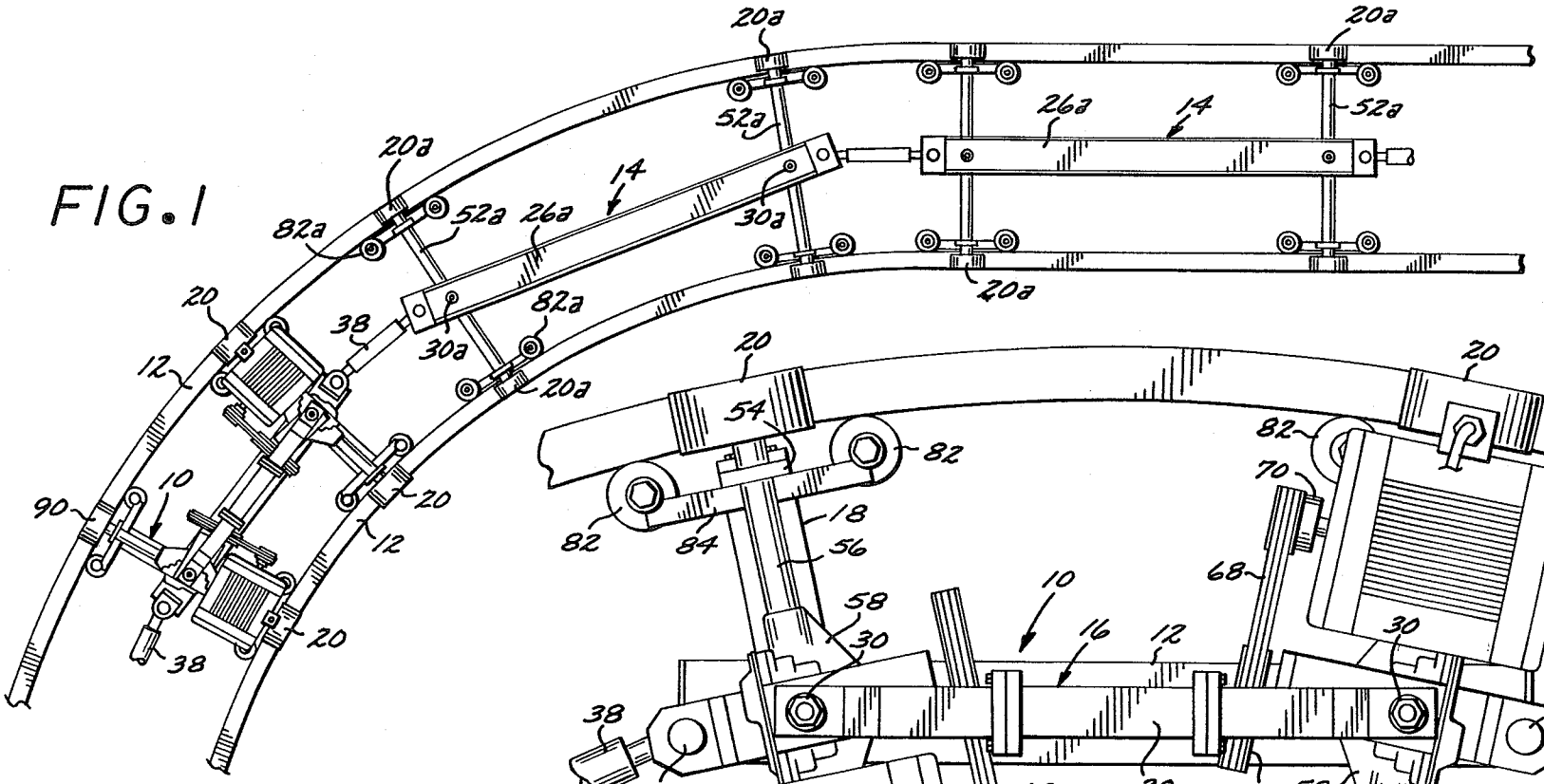
FIG. 1 is a partial top plan view of the chassis of a propulsion vehicle according to the present invention, coupled to a pair of passenger vehicle chassis for travel along a pair of track rails.

As shown in the drawing, for purposes of illustration, the invention is embodied in a novel amusement ride propulsion vehicle. The number of passengers and vehicles which can be handled by the propulsion vehicle depends upon the traction which can be developed between the drive wheels and the track rails. When vehicle loads or the grade of the trackway are too great, the drive wheels slide and additional propulsion vehicles have to be added.

In accordance with the invention, an amusement ride vehicle is provided which includes cooperating drive wheels and pinch wheels which are urged together to tightly grip the track rails at all times with a force limited only by the physical characteristics of the drive and pinch wheel tire compounds. The pinch wheels accomplish this while providing important "up-stop" prevention, which is especially important when the trackway is characterized by abrupt vertical and horizontal undulations. The system also allows deliberate separation of the vehicle from the trackway for maintenance or storage.

FIG. 1 illustrates an amusement ride vehicle 10 adapted to travel along a trackway defined by a pair of transversely spaced apart track rails 12. The vehicle 10 is illustrated as a tractor or propulsion vehicle for pulling passenger vehicles 14 in a train. For brevity and clarity of illustration, the coach portions of the vehicles 10 and 14 which house and seat the passengers are omitted and only the chassis of each vehicle is shown.

Figure 2:
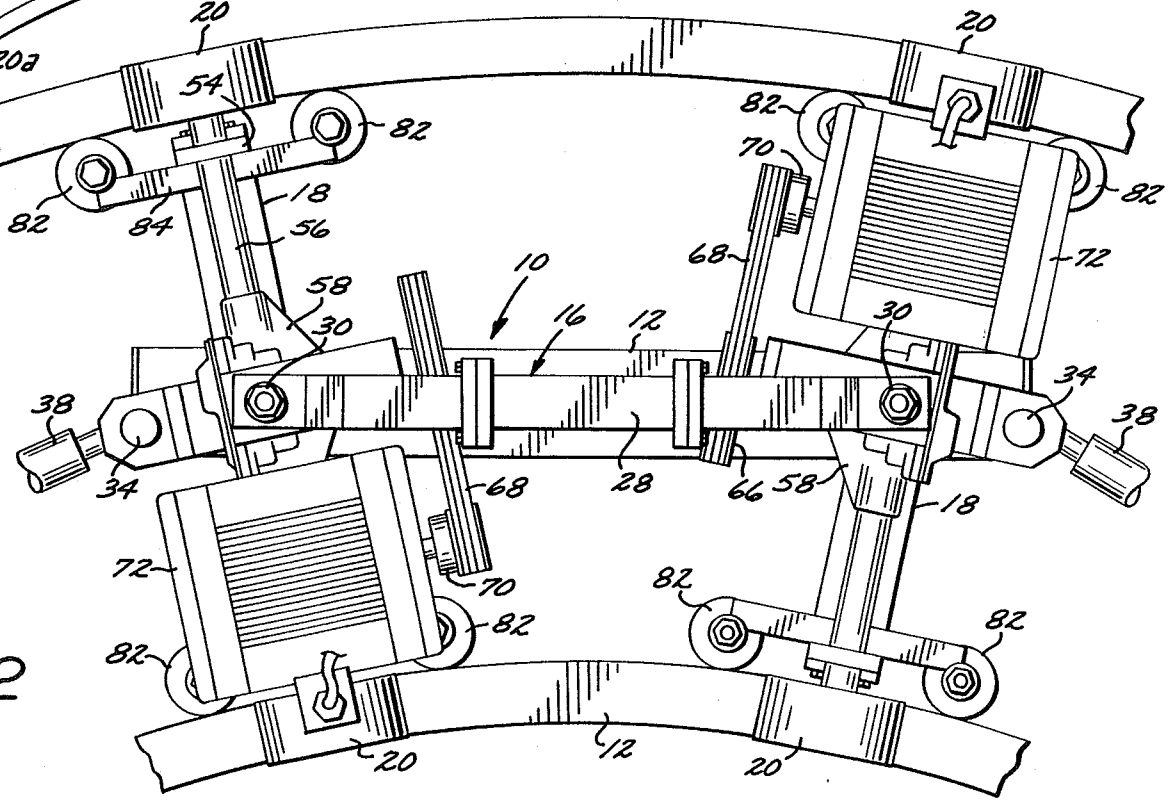
FIG. 2 is a top plan view of the propulsion vehicle and associated track rails on an enlarged scale.

The vehicle 10 includes a longitudinally oriented main frame which pivotally carries a pair of transverse frames 18 at its opposite extremities. Each transverse frame includes rubber tired drive wheels 20 which are adapted to roll upon the rails 12. The traction of the drive wheels 20 is improved by rubber tired pinch wheels 22, as seen in FIG. 2, located beneath the drive wheels and forcibly gripping or pinching the rails 20 between them and the drive wheels. According to the invention the pinch wheels 22 are constantly forced against the track rails by strut assemblies 24 which are disconnectable to allow the pinch wheels 22 to be retracted to the position illustrated in FIG. 6 for lifting of the vehicle 14 off the track rails when the vehicle is to be stored or maintained. This arrangement provides improved drive traction and also important up-stop protection, which is needed in amusement ride vehicles to insure that the vehicle does not lift off the track rails during abrupt changes in vehicle direction.

The main frame 16 is generally longitudinally oriented and includes an elongated lower frame member 26 and an upper frame member 28 which extends above and in parallel relationship to the lower member 26. The two are connected together by vertical posts 27.

The upper member 28 comprises a central section having end flanges connected to the flanged ends of the end sections which are downwardly offset and then extended horizontally to form mounting portions for upper pivot shafts 30. A pair of lower pivot shafts 32 vertically aligned with the shafts 30 are rotatably carried by the lower frame member 26 adjacent its forward and rearward extremities, as seen in FIG. 4. The shafts 30 and 32 define vertical pivot axes at opposite ends of the main frame to pivotally mount the pair of transverse frames 18.

Figure 3:
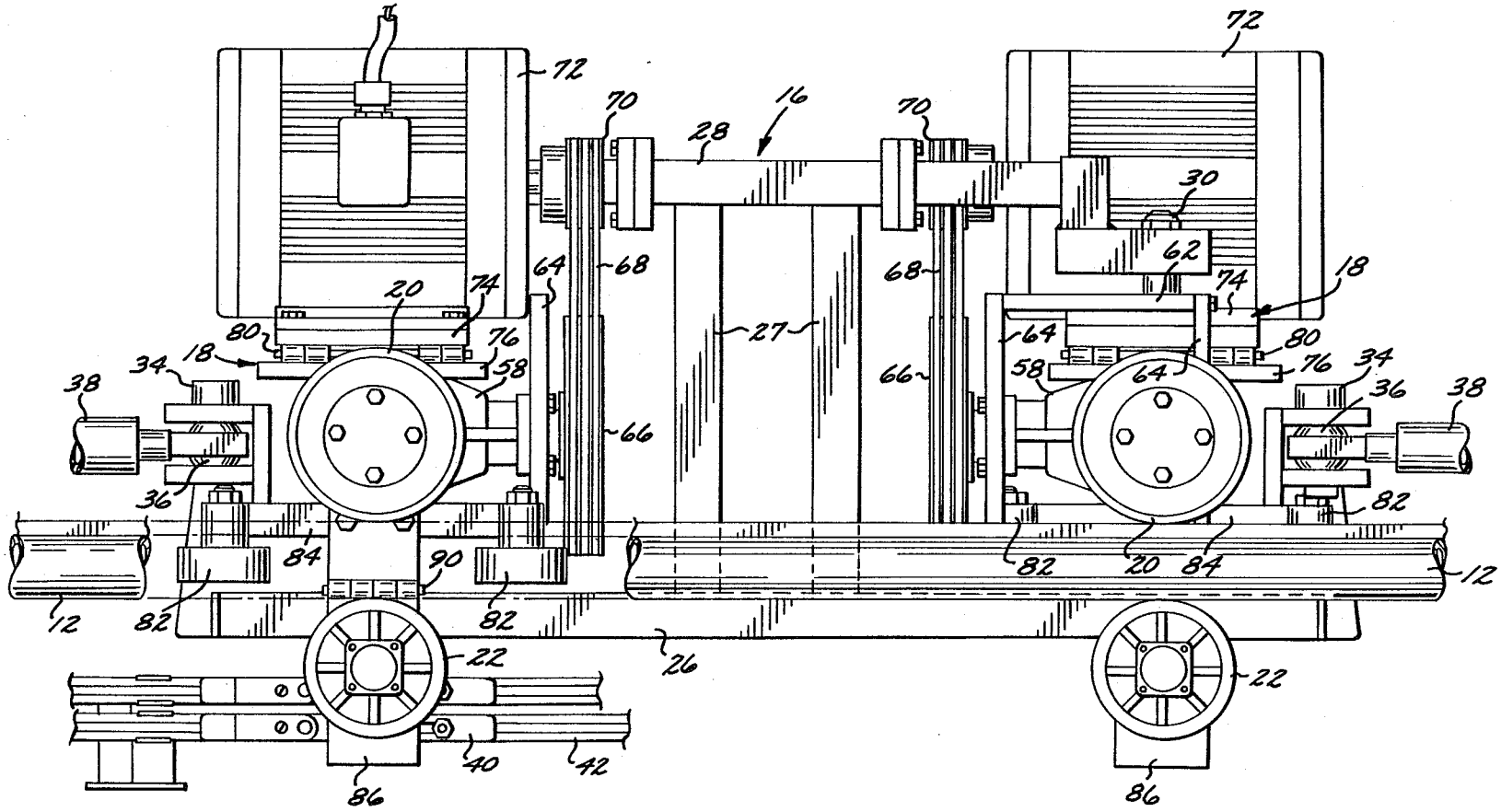
FIG. 3 is a side elevational view of the propulsion vehicle.

The main frame 16 also carries structure by which it is pivotally connected to the passenger vehicles 14. This structure includes a pair of pivot fittings 34 fixed at the ends of the main frame 16, respectively, as best seen in FIG. 3, and each accepting a pivot ball 36 of an elongated tow bar 38. This arrangement permits relative pivotal movement of the attached vehicles about a vertical axis defined by the pivot fitting 34 and ball 36. Any combination of propulsion vehicles 10 and passenger vehicles 14 can be coupled together for travel along the trackway defined by the rails 12.

The vehicle 10 derives electrical power from a trackway buss bar and for this reason the main frame is provided with usual and conventional power pickup assemblies 40 having wiper elements adapted to engage the opposite vertical faces of a buss bar 42.

The bar 42 extends longitudinally of the trackway, forming part of the track system. The latter comprises the pair of track rails 12 which are tubular in configuration and connected together by cross ties 44. The buss bar 42 is fixed to the ties 44, as seen in FIG. 4, and the ties are located at spaced intervals along the length of the trackway. At their ends the ties are attached to track uprights 46 having base plates 48 at their lower ends resting upon a concrete foundation or the like (not shown). The upper ends of the track uprights are fixed to horizontal, inwardly directed rail supports 50 which are welded or otherwise fixed to the outer surfaces of the rails 12.

Each rail 12 includes a top surface defined by a flat bar which is bent to conform to the curvature of the track. The bar is welded in position to provide an upper or running surface for the drive wheels 20, as seen in FIG. 4, with the pinch wheels 22 riding upon the under surfaces of the track.

Each transverse frame 18 includes an elongated base member 52 attached at its ends to vertical plates or frame sides 54. The sides fixedly support the outward extremities of a pair of differential axles 56 which form part of a differential drive 58.

The central portion of the drive 58 is further supported by a subframe of the associated transverse frame. As best seen in FIGS. 3 and 4, the subframe includes vertically spaced apart, longitudinally oriented upper and lower plates 60 and 62, seen in dotted outline in FIG. 4, and vertically oriented end plates 64 fixed to the plates 60 and 62 at their upper and lower ends.

Each lower plate 62 is fixed to a transverse frame base member 52 adjacent one of the lower pivot shafts 32. In similar fashion, each upper plate 60 is located adjacent an associated upper pivot shaft 30 so that each subframe provides the pivotal interconnection between the associated transverse frame and the main frame 16. One of the end plates 64 also rotatably supports a belt pulley 66 connected by an endless belt assembly 68 to motor pulley 70. The pulley 70 is driven by an electric motor 72 which derives its power and control through the previously mentioned interengagement between the power pickup assemblies 40 and the buss bar 42. Rotation of the pulley 70 rotates the pulley 66 to drive the associated differential drive 58.

Each motor is supported by a movable motor mount or plate 74 to which the motor is fixed, and by a fixed motor mount 76. The latter comprises a horizontal plate welded to a pair of vertically oriented, transversely spaced clamps 78 which are fixed to an associated one of the differential axles 56.

The movable and fixed motor mounts 74 and 76 include interengaging hinge knuckles which are relatively pivotal about about a hinge pin 80 to raise and lower the motor pulley 70 relative to the belt pulley 66 for increasing the tension in the belt 68. A selected position of adjustment of the movable mount 74 is obtained by operation of an adjustment screw assembly 82 carried by the fixed motor mount and extending upwardly into engagement with the movable mount 74, as seen in FIG. 4.

Each transverse frame 18 not only supports a differential drive 58, two drive wheels 20 and the drive means which includes one of the electric motors 72, but it also mounts at its outer extremities pairs of rubber tired guide rollers 82. These are in rolling engagement with the track rail side surfaces and guide the vehicle along the trackway. Each pair of guide rollers 82, straddle, one ahead of and one behind, an associated drive wheel, as seen in FIG. 3. The rollers are rotatably carried at opposite ends of a bar or guide mount 84 which is attached to the adjacent transverse frame side 54.

Up-stop protection is provided by wheel carriers 88 which each include a depending plate 86 having hinge knuckles cooperating with hinge knuckles of the associated transverse frame side 54. Each wheel carrier is pivotable about a longitudinal axis defined by a hinge pin 90 extending through the knuckles.

Each wheel carrier rotatably mounts a pinch wheel 22 and its pivotable action enables the pinch wheel to be pivoted inwardly from a pinch position, illustrated in FIG. 4, to a retracted position, illustrated in FIG. 6. In the latter position the vehicle may be lifted off the track rails for maintenance or storage.

In normal operation the pinch wheels 22 are forcibly urged against the track rail under surfaces by the strut assemblies 24. Each strut assembly comprises a tab or pinch wheel mount 94 fixed to the base of the wheel carrier plate 86, and a depending tab or rod mount 96 fixed to the underside of the transverse frame member 52. A turnbuckle assembly 98 is pivotally connected between the mounts 94 and 96 and includes a turnbuckle rod rotatable in one direction to urge the associated pinch wheel carrier 88 outwardly into more forcible engagement with the track rail under surfaces, and rotatable in the opposite direction to ease such forcible engagement. The opposite ends of the turnbuckle assembly are disconnectable at one or both ends by disassembling a nut and bolt assembly 100 so that each wheel carrier 88 is free to move between the pinch position of FIG. 4 to the retracted position of FIG. 6.

The strut assemblies 24 are adjusted in normal operation so that there is always a preloading or forcible engagement of the pinch wheels with the rail under surfaces so that the rails are squeezed or pinched between the drive wheels and pinch wheels enough to increase the traction to a level necessary to propel the assembled vehicles 10 and 14 of the train. Such constant forcible engagement is also important to provide constant up-stop protection by preventing any significant upward movement of the vehicle as it negotiates abrupt changes in trackway direction.

Although the motors 72 and differential drives 58 can be arranged in any way desired, it has been found convenient to arrange the differential drives generally along the axis of the main frame, as illustrated, with one motor adjacent the outer end of one of the transverse frames, and the other motor adjacent the opposite extremity of the other transverse frame. This provides good weight distribution and balance.

The construction of the passenger vehicles 14 is similar in many respects to that of the propulsion vehicle 10, except for the elimination of the propulsion components. Accordingly, without describing such vehicles in detail, parts of the passenger vehicles which find substantial correspondence in structure and function to those of the propulsion vehicle 10 are designated with corresponding reference numerals with the subscript "a".

From the foregoing, it will be appreciated that the amusement ride vehicle of the invention enables improved traction to be developed by the use of pinch wheels operating in conjunction with drive wheels on pair of spaced apart track rails of the type common in amusement rides, with the pinching or forcible gripping of the rails between the drive wheels and pinch wheels being constant to afford continuous up-stop protection against inadvertent upward lifting of the vehicle from the tracks during the course of the ride, while yet enabling the pinch wheels to be deliberately retracted out of the way to allow ready upward separation or lifting of the vehicle from the track rails for maintenance or storage.

While a particular form of the invention has been illustrated and described, it will be apparent that various modifications can be made without departing from the spirit and scope of the invention.

I claim:

1. A vehicle adapted to travel along a trackway upon a pair of transversely spaced apart track rails each having an upper surface, a side surface and an under surface, the vehicle comprising:

a longitudinally oriented main frame having forward and rearward extremities;

a pair of transverse frames pivotally carried by the main frame adjacent the forward and rearward extremities of the main frame;

drive means carried by the transverse frames and including drive wheels adapted for driving engagement with the track rail upper surfaces to propel the vehicle along the trackway;

up-stop wheel carrier means pivotally mounted to the transverse frames and including pinch wheels located vertically opposite the drive wheels, respectively, each wheel carrier means being pivotable about a longitudinal axis between a pinch position for rolling engagement of the pinch wheels with the track rail under surfaces, and a retracted position for disengagement of the pinch wheels from the track rail under surfaces whereby the vehicle can be lifted from the track rails; and strut means connected between the wheel carrier means and the transverse frames, respectively, and operative to hold the wheel carrier means in their pinch positions in forcible rolling engagement with the track rail under surfaces at all times whereby the track rails are constantly forcibly gripped and pinched between the drive wheels and the pinch wheels, and whereby the pinch wheels provide constant up-stop protection by reason of their constant forcible engagement with the track rail under surfaces, the strut means being disconnectable to enable the wheel carrier means to be pivoted to their retracted positions.

2. A vehicle according to claim 1 and including guide roller means carried by the transverse frames and including guide rollers adapted for rolling engagement with the track rail side surfaces to guide the vehicle along the trackway.

3. A vehicle according to claim 2 wherein the guide roller means comprises a plurality of elongated guide roller mounts fixed to the opposite extremities, respectively, of the transverse frames, the extremities of each guide roller mount mounting a pair of the guide rollers and locating the pair of guide rollers in advance and behind the associated one of the drive wheels.

4. A vehicle according to claim 1 wherein the drive means comprise: a pair of differential axles fixed to the transverse frames, respectively, and each coupled in driving relation to a pair of the drive wheels; a pair of electric motors; a pair of belt drives coupling the electric motors, respectively, to the differential axles; and a pair of motor support means fixed to the axles and mounting the electric motors, respectively.

5. A vehicle according to claim 4 wherein each of the motor support means comprises a fixed motor mount fixed to the associated axle, and a movable motor mount mounting one of the electric motors and pivoted to the fixed portion for adjusting the belt tension of the associated belt drive.

6. A vehicle according to claim 4 wherein the main frame includes upper and lower frame members overlying and underlying, respectively, the motor support means; and including upper and lower pivot means carried by the upper and lower frame members and pivotally connecting the motor support means and associated transverse frame to the main frame.

7. A vehicle adapted to travel along a trackway upon a pair of transversely spaced apart track rails each having an upper surface, a side surface and an under surface, the vehicle comprising:

a longitudinally oriented main frame having forward and rearward extremities;

a pair of transverse frames pivotally carried by the main frame adjacent the forward and rearward extremities of the main frame;

drive means including a pair of differential axles fixed to the transverse frames, respectively, further including drive wheels carried at the outer extremities of the axles, respectively, and adapted for driving engagement with the track rail upper surfaces to propel the vehicle along the trackway;

a plurality of up-stop wheel carrier means pivotally mounted to the extremities of the transverse frames, respectively, each wheel carrier means including a pinch wheel adapted to underlie the associated one of the drive wheels, and each wheel carrier means being pivotable about a longitudinal axis between a pinch position for rolling engagement of the associated pinch wheel with the track rail undersurface, and a retracted position for disengagement of the pinch wheel from the track rail under surface whereby the vehicle can be lifted from the track rails; and strut means connected between the wheel carrier means and the transverse frames, respectively, and operative to hold the wheel carrier means in their pinch positions in forcible rolling engagement with the track rail under surfaces at all times whereby the track rails are constantly forcibly gripped and pinched between the drive wheels and the pinch wheels, and whereby the pinch wheels provide constant up-stop protection by reason of their constant forcible engagement with the track rail under surfaces, the strut means being disconnectable to enable the wheel carrier means to be pivoted to their retracted positions.

8. A vehicle according to claim 7 and including guide roller means carried by the transverse frames and including guide rollers adapted for rolling engagement with the track rail side surfaces to guide the vehicle along the trackway.

9. A vehicle according to claim 7 wherein the strut means comprises a plurality of pinch wheel mounts rotatably carrying the pinch wheels, respectively, a pair of the pinch wheel mounts being pivoted to the opposite extremities, respectively, of each of the transverse frames, the strut means further comprising a plurality of elongated rod mounts fixed to the transverse frames, and a corresponding plurality of rod members pivotally carried at their opposite extremities by the pinch wheel mounts and rod mounts respectively, and adjustably movable relative to the pinch wheel mounts and the rod mounts to adjust the length of each rod member and thereby adjust the traction between the track rails and the drive wheels and pinch wheels.

10. A vehicle according to claim 7 wherein the drive means further comprises a pair of electric motors; a pair of belt drives coupling the electric motors, respectively, to the differential axles; and a pair of motor support means fixed to the axles and mounting the electric motors, respectively.

11. A vehicle according to claim 10 wherein each of the motor support means comprises a fixed motor mount fixed to the associated axle, and a movable motor mount mounting one of the electric motors and pivoted to the fixed portion for adjusting the belt tension of the associated belt drive.

* * * * *